US008840046B2

(12) United States Patent
Jones et al.

(10) Patent No.: US 8,840,046 B2
(45) **Date of Patent: *Sep. 23, 2014**

(54) HAND HELD PAINT SPRAYER WITH PAINT CUP AND REVERSIBLE TIP

(71) Applicant: Wagner Spray Tech Corporation, Plymouth, MN (US)

(72) Inventors: Michael B. Jones, Excelsior, MN (US); Terry R. Reents, Lakeville, MN (US); Steven D. Dodge, Chanhassen, MN (US); Christopher A. Jensen, Crystal, MN (US)

(73) Assignee: Wagner Spray Tech Corporation, Plymouth, MN (US)

( * ) Notice: Subject to any disclaimer, the term of this patent is extended or adjusted under 35 U.S.C. 154(b) by 63 days.

This patent is subject to a terminal disclaimer.

(21) Appl. No.: 13/621,559

(22) Filed: Sep. 17, 2012

(65) Prior Publication Data

US 2013/0168469 A1 Jul. 4, 2013

Related U.S. Application Data

(63) Continuation of application No. 12/501,795, filed on Jul. 13, 2009, now Pat. No. 8,267,332.

(60) Provisional application No. 61/080,310, filed on Jul. 14, 2008.

(51) Int. Cl.

| | |
|---|---|
| ***B05B 1/34*** | (2006.01) |
| ***B05B 9/08*** | (2006.01) |
| ***B05B 15/02*** | (2006.01) |
| ***B05B 11/00*** | (2006.01) |

(52) U.S. Cl.

CPC ..... *B05B 11/3001* (2013.01); *B05B 1/3436* (2013.01); *B05B 9/0861* (2013.01); *B05B 15/0283* (2013.01)

USPC ..... 239/463; 239/526

(58) Field of Classification Search

CPC ..... B05B 1/341; B05B 7/02

USPC ..... 239/461, 463, 465, 476, 482, 499, 525, 239/526, 600

See application file for complete search history.

(56) References Cited

U.S. PATENT DOCUMENTS

| | | | |
|---|---|---|---|
| 1,340,136 | A | 5/1920 | Murphy et al. |
| 3,899,134 | A | 8/1975 | Wagner |
| 4,036,438 | A | 7/1977 | Soderlind et al. |

(Continued)

OTHER PUBLICATIONS

U.S. Appl. No. 61/080,310, filed Jul. 14, 2008, 12 pages.

(Continued)

*Primary Examiner* — Davis Hwu

(74) *Attorney, Agent, or Firm* — Christopher J. Volkmann; Kelly, Holt & Christenson, PLLC

(57) ABSTRACT

A self-contained, hand-held paint spray gun apparatus having a paint reservoir on the gun and a turret assembly having a reversible tip for spraying paint from the reservoir through the tip and a swirl chamber adapter located between the gun and turret assembly. The tip is reversible between a SPRAY position and a CLEAN position to enable a user of the paint spray gun to rapidly and conveniently clear an obstruction in the tip and continue spraying without removing the tip. The swirl chamber adapter has a generally planar face opposing a swirl valve in the gun and forming a swirl chamber upstream of the turret assembly and has a centrally located bore extending from the generally planar face to the outlet of the adapter.

20 Claims, 7 Drawing Sheets

(56) References Cited

U.S. PATENT DOCUMENTS

| | | | |
|---|---|---|---|
| 4,620,669 | A | 11/1986 | Polk |
| 4,693,423 | A | 9/1987 | Roe et al. |
| 4,735,362 | A | 4/1988 | Trautwein et al. |
| 4,744,516 | A | 5/1988 | Peterson et al. |
| 5,060,869 | A | 10/1991 | Bekius |
| 5,340,029 | A | 8/1994 | Adams |
| 5,667,144 | A | 9/1997 | Snetting |
| 5,749,528 | A | 5/1998 | Carey et al. |
| 5,842,638 | A | 12/1998 | Reents et al. |
| 5,911,364 | A | 6/1999 | Johnson et al. |
| 7,028,916 | B2 | 4/2006 | Micheli |

OTHER PUBLICATIONS

Prosecution documents from U.S. Appl. No. 12/501,795, filed Jul. 13, 2009, 47 pages.

HAND HELD PAINT SPRAYER WITH PAINT CUP AND REVERSIBLE TIP

CROSS REFERENCE TO RELATED APPLICATION

This application claims the benefit of U.S. Provisional Application 61/080,310 filed Jul. 14, 2008, the entire contents of which are hereby expressly incorporated by reference.

TECHNICAL FIELD

This invention relates to the field of hand-held paint sprayers carrying a paint reservoir and sometimes known as "cup guns" and to the field of reversible tips for paint spray guns.

BACKGROUND

In the past, cup guns were not provided with reversible spray tips, even though it was known to provide spray tips which were rotatable in a direction perpendicular to the spray direction to provide orientation of a fan-shaped spray pattern from a vertical to a horizontal orientation. To clean an obstruction from such tips, including the rotatable tips, it was necessary to remove the tip from the gun, a time-consuming and somewhat involved process.

In a different field still related to spraying paint, it was known to use turrets with reversible tips in airless spray painting systems, where the spray gun is connected to a remote paint pump by a high pressure hose. In such systems, the pump and paint reservoir were too large to be combined with the spray gun, and thus were located remote from the hand held spray gun, supported by the floor (indoors) or the ground (outdoors). However, heretofore, reversible spray tips were not available for cup guns.

SUMMARY

The present invention provides for a combination of a reversible spray tip and turret with a hand-held paint spray gun carrying a paint reservoir. Providing the reversible tip on a cup gun allows quick and convenient clearing of obstructions from the tip, allowing a user to rapidly switch from a SPRAY mode to a CLEAN mode and back again to clear an obstruction and continue spraying in a manner heretofore not available with a cup gun type paint sprayer. In the practice of the present invention, a swirl chamber adapter is required between the gun outlet and the spray tip inlet.

DETAILED DESCRIPTION

Figure 1:
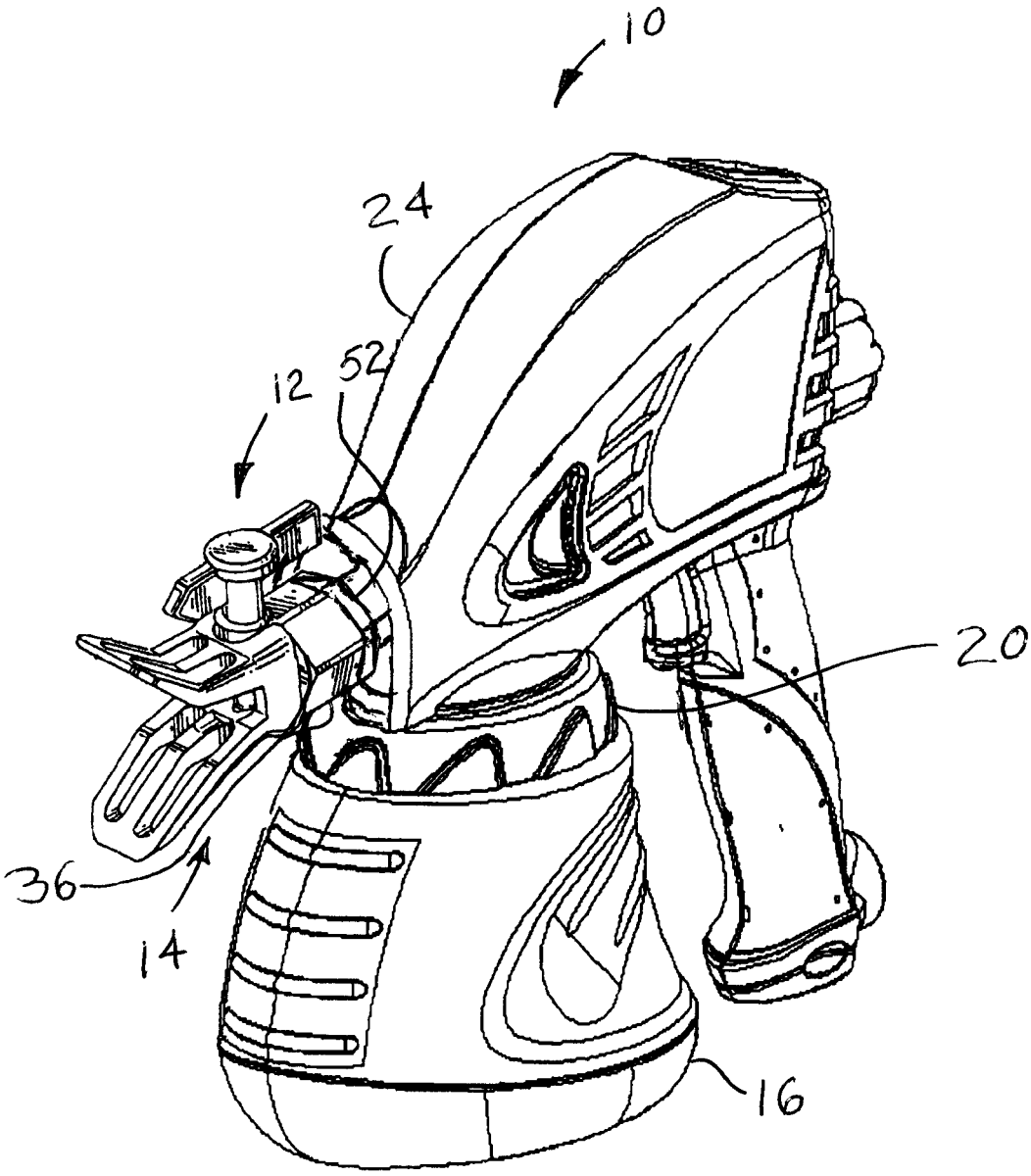
FIG. 1 is a perspective view of a cup gun and reversible tip and holder assembly useful in the practice of the present invention.
Figure 2:
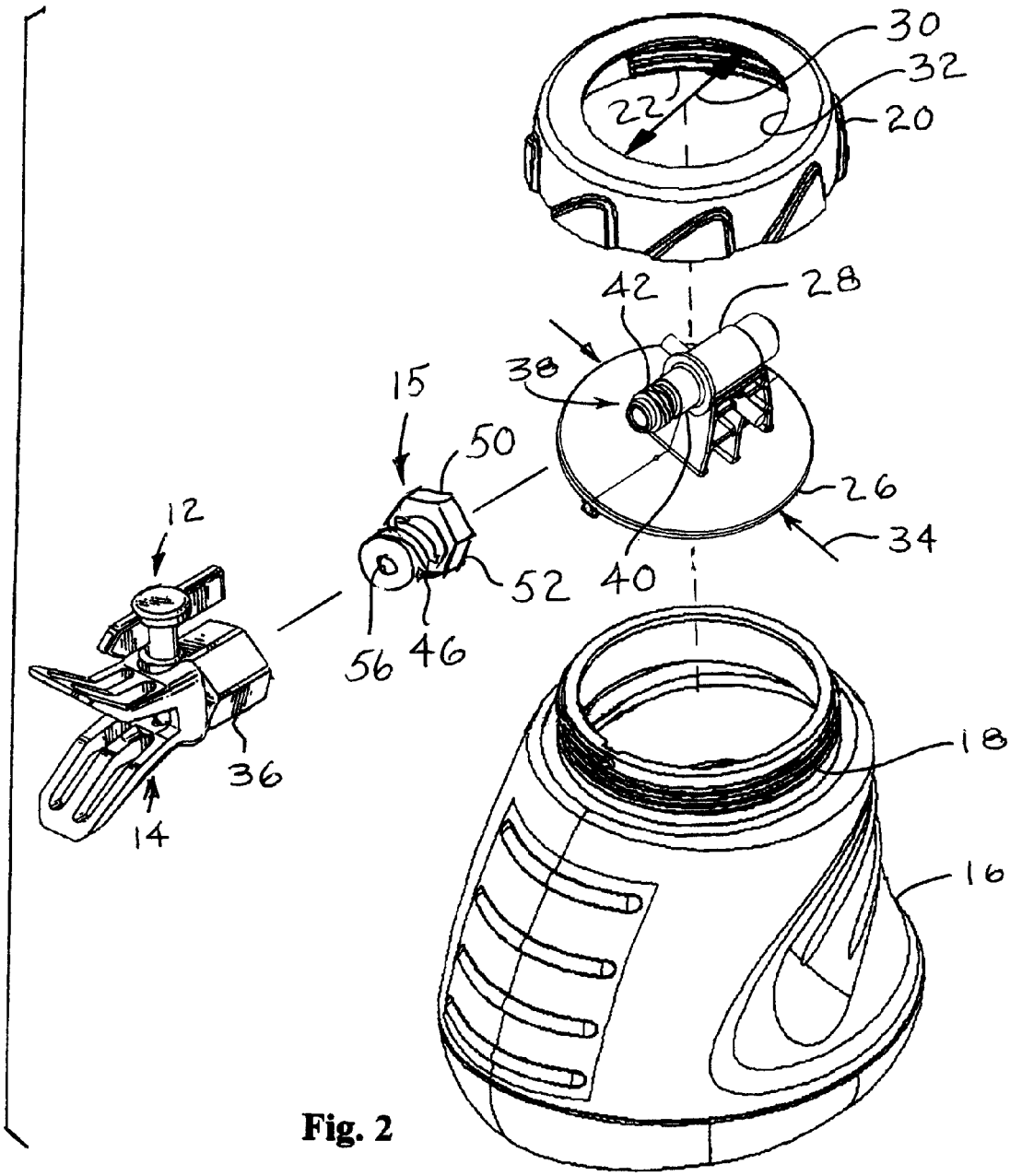
FIG. 2 is an exploded view of some of the parts shown in FIG. 1 to illustrate certain aspects of the present invention.

Referring to the Figures, a hand-held paint spray gun 10 is shown in FIG. 1, along with a reversible tip 12 mounted in a turret assembly 14. A swirl chamber adapter 15 is mounted between the turret assembly 14 and an outlet of gun 10. Gun 10 is shown with a paint reservoir 16, often known as a "paint cup" attached thereto. The gun 10 (with or without the reservoir) is often referred to as a "cup gun." As used herein, "cup gun" refers to a hand-held paint spray gun having an arrangement for directly mounting the paint reservoir 16 on the gun 10. As may be seen most clearly in FIG. 2, the paint cup 16 may have external threads 18 received in a ring 20 having internal threads 22 with the ring 20 being an independent part (as shown here), or (alternatively) the internal threads 22 may be formed as a part of a gun housing 24. When the ring version of attachment of the paint cup is used, the ring 20 is received over a circular flange 26 of a cylinder housing 28, it being understood that a diameter 30 of an aperture 32 in the ring 20 is smaller than a diameter 34 of flange 26.

Figure 5:
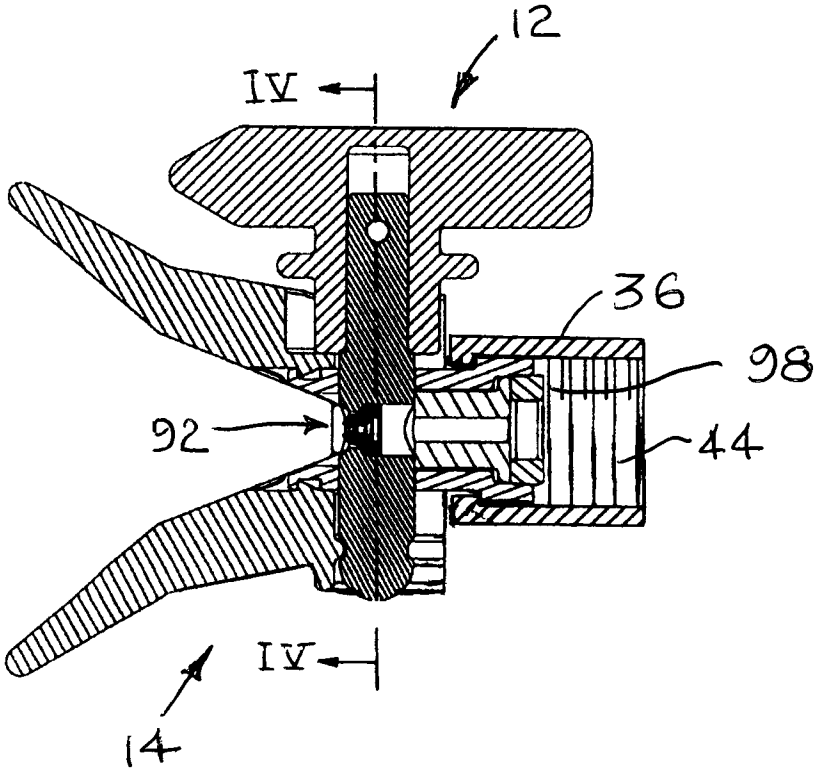
FIG. 5 is a section view taken along line V-V of FIG. 4.

Turret assembly 14 has a mounting nut 36 to secure the assembly 14 to the swirl chamber adapter 15, which, in turn, is secured to a front 38 of a piston cylinder 40 carried in cylinder housing 28. External threads 42 are located on the front 38 of the cylinder 40. Internal threads 44 are located in the nut 36, as may be seen in FIGS. 2 and 5.

Figure 7:
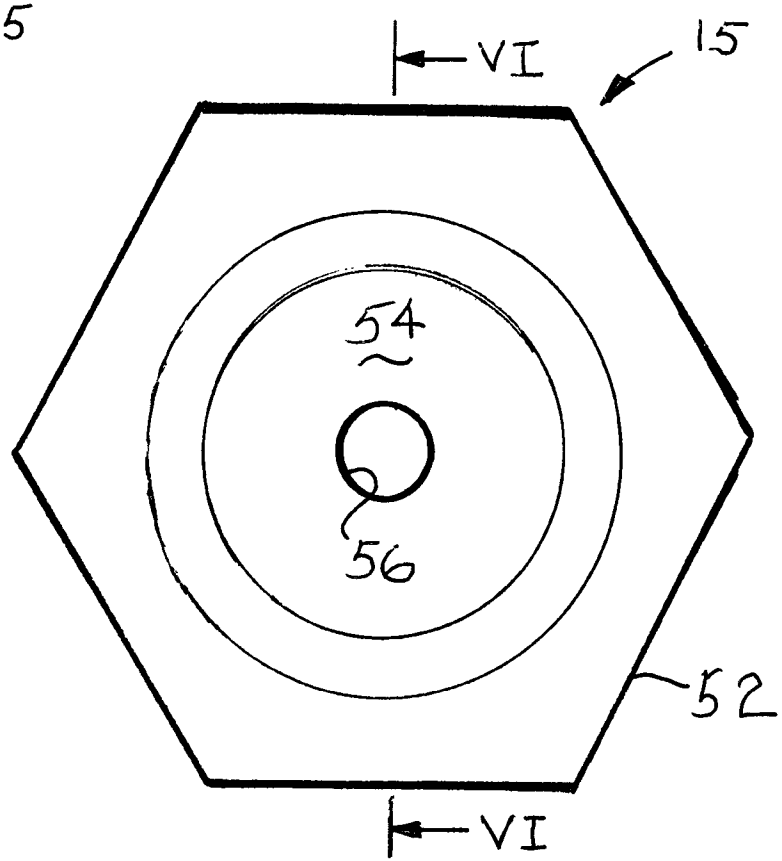
FIG. 7 is an end view of the swirl chamber adapter of FIG. 6.
Figure 6:
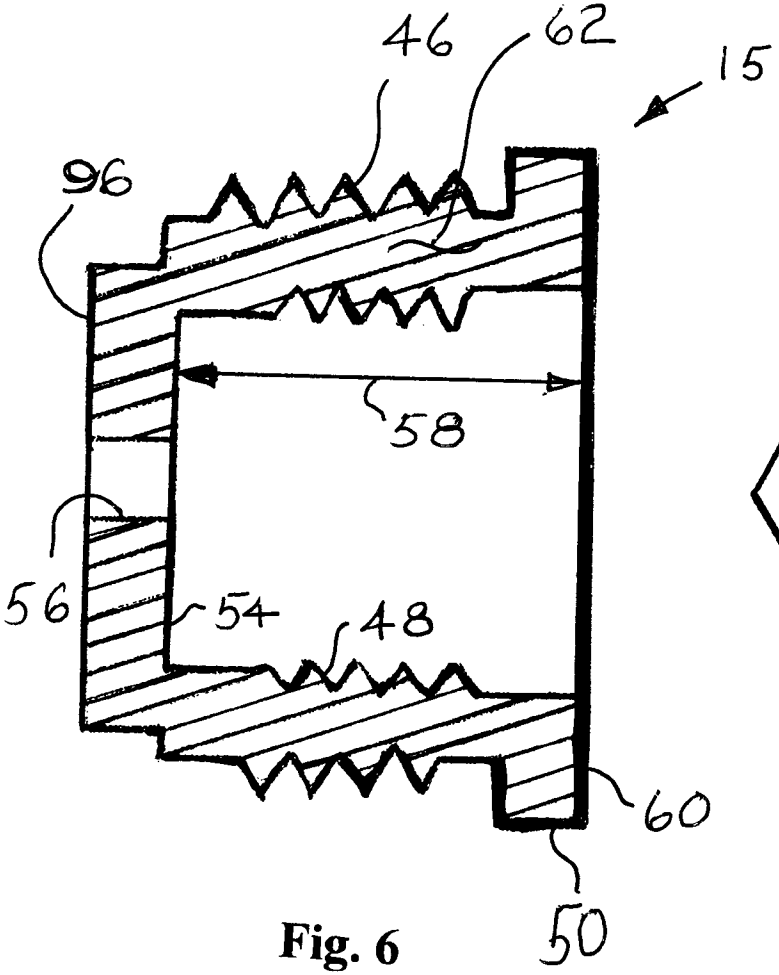
FIG. 6 is a side section view of a swirl chamber adapter taken along line VI-VI of FIG. 7.
Figure 8:
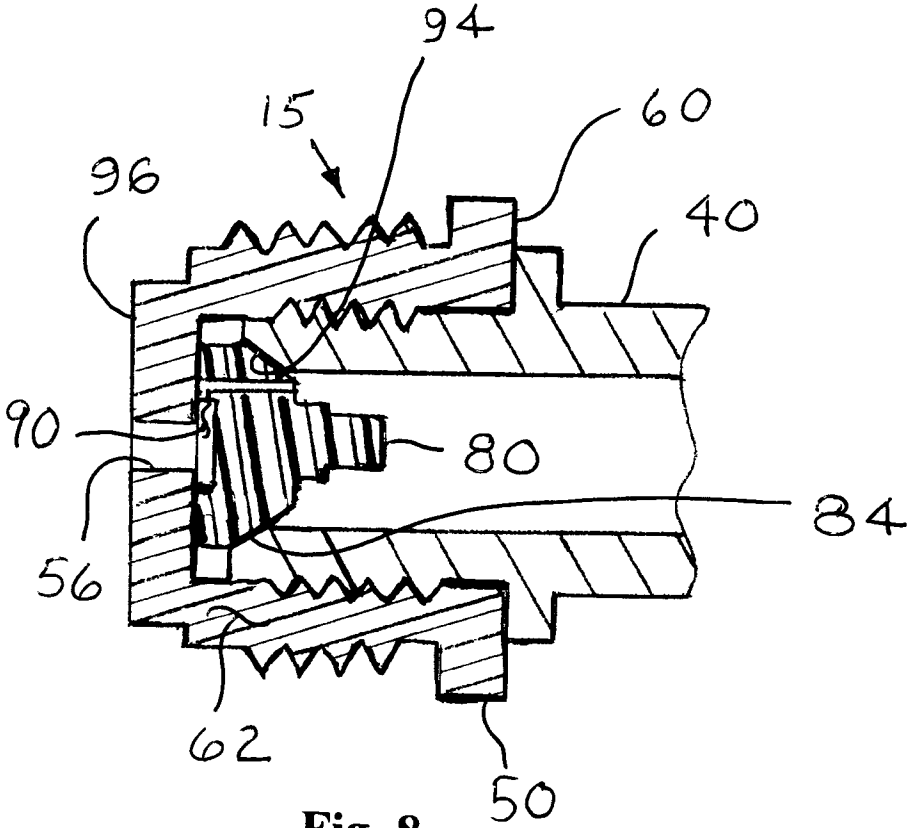
FIG. 8 is a partial side section view of an assembly of an outlet of the cup gun, swirl valve, and swirl chamber adapter useful in the practice of the present invention.

Referring now also to FIGS. 6, 7 and 8, the swirl chamber adapter 15 has a set of external threads 46, a set of internal threads 48 and a flange 50 with a hexagonal periphery 52. Although a hexagonal periphery is shown, it is to be understood to be within the present invention to provide the adapter 15 with an alternative external gripping surface in place of hexagonal periphery 52. Examples of such alternative external gripping surfaces include, but are not limited to a spline surface or a pair of parallel wrench flats or a knurled hand ring. Swirl chamber adapter 15 also has a generally planar face 54 with a through bore 56. Adapter may be formed with a predetermined distance 58 between face 54 and a surface 60 flange 50. A generally cylindrical wall 62 connects the flange 50 to the face 54.

Figure 3:
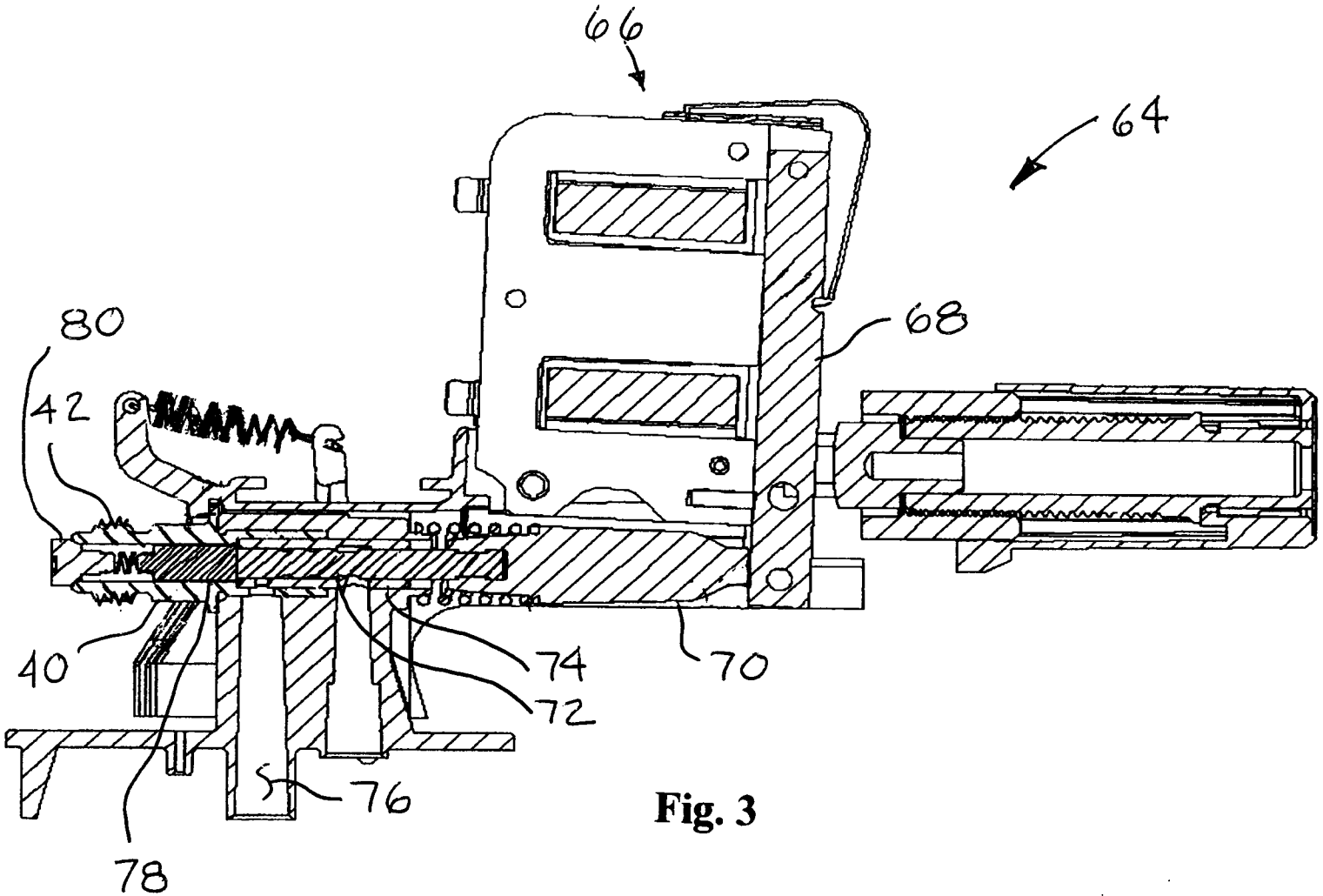
FIG. 3 is side sectional view of parts of the cup gun of FIG. 1.
Figure 10:
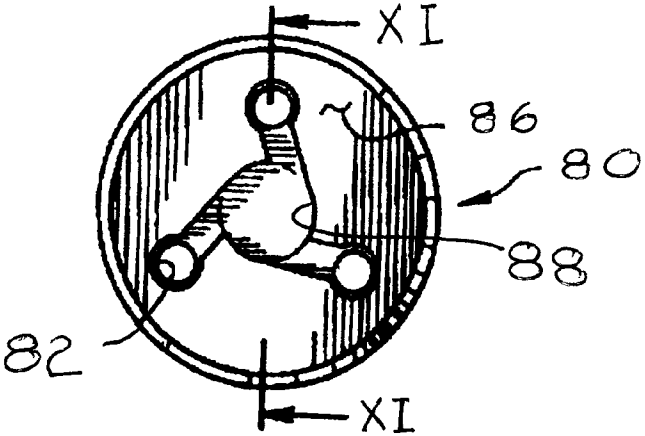
FIG. 10 is an end view of the swirl valve of FIG. 9.
Figure 9:
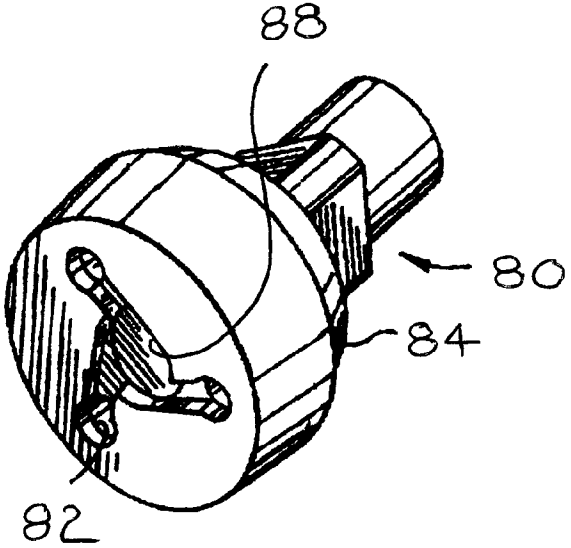
FIG. 9 is an enlarged perspective view of the swirl valve of FIG. 8.
Figure 11:
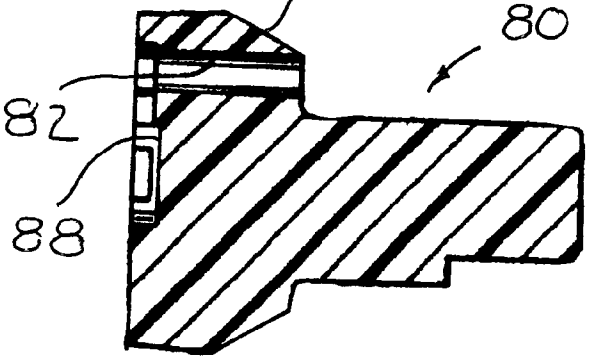
FIG. 11 is a section view taken along line XI-XI of FIG. 10.

Referring now to FIG. 3, a side section view of parts of an internal assembly 64 of the cup gun 10 may be seen. An E-I lamination motor 66 has a reciprocating member 68 driving a plunger 70 connected to a piston 72, which reciprocates in a sleeve 74 secured in cylinder 40. Paint is drawn up through a siphon tube (not shown) in a channel 76 and delivered past a check valve 78 to a swirl valve 80. Referring now also to FIGS. 9, 10 and 11, paint is then delivered through passageways 82 in the swirl valve 80. Swirl valve 80 also has a cone shaped surface 84 and a generally planar face 86. A recess 88 in face 86 forms part of a swirl chamber 90 (shown in FIG. 8), and is in fluid communication with passageways 82.

Figure 4:
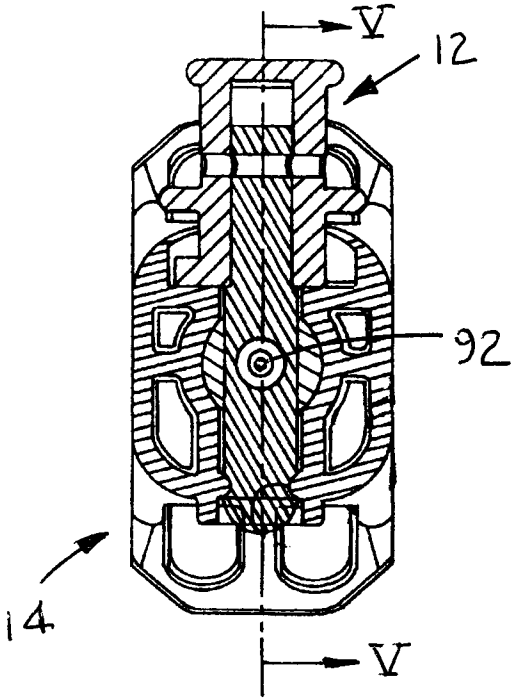
FIG. 4 is a section view of a reversible tip and holder assembly taken along line IV-IV of FIG. 5.

Referring now more particularly also to FIG. 8, the swirl chamber adapter 15. shown with the swirl valve 80 and the cylinder 40 in section. The combination of face 54 and recess 88 forms the swirl chamber 90 which is in fluid communication with bore 56, allowing paint to flow from the swirl chamber 90 to the turret assembly 14 and exit through an orifice 92 in the reversible tip 12 (see FIGS. 4 and 5). The predetermined distance 58 allows compression of the swirl valve 80, urging the cone shaped surface 84 against a mating cone shaped seat 94 in the cylinder 40. A front surface 96 of the adapter 15 is sealed by a resilient washer 98 in the turret assembly 14.

The invention may thus be seen to be a combination of a) a hand-held paint spray gun apparatus having a reciprocating piston in the gun for pressurizing paint and a swirl valve for imparting swirling motion in the paint to be sprayed with b) a turret assembly mounted on the gun and having a reversible spray tip therein.

In another aspect, the invention may also be seen to be an improvement to the combination of the spray gun and reversible spray tip or turret assembly, the improvement including a swirl chamber adapter positioned between an outlet of the swirl valve and an inlet of the turret assembly.

The adapter may include a) a generally planar face opposing the swirl valve in the gun and b) a swirl chamber upstream of the turret assembly.

The adapter may further include a centrally located bore extending from the generally planar face to an outlet of the adapter to deliver paint from the gun to the turret assembly and reversible spray tip.

In yet another aspect, the invention may be seen to include the combination of a cylinder having external threads and containing the swirl valve in the spray gun.

In a still further aspect, the invention may include internal threads on the adapter for coupling the adapter to the cylinder.

In a still further aspect, the adapter of the present invention may include an external flange spaced apart from the planar face by a predetermined distance. The predetermined distance may be selected to provide a predetermined axial preload on the swirl valve.

The adapter may also include external threads for receiving the turret assembly.

The adapter may also include an external gripping surface, which may be in the form of a hexagonal periphery, a spline surface, a pair of parallel wrench flats, or a knurled hand ring.

The following is claimed:

1. A hand-held paint spray cup gun apparatus comprising:
- a removable paint cup;
- an airless paint pump assembly configured to receive paint from the paint cup and having a reciprocating piston for pressurizing the paint;
- a motor configured to drive the piston;
- a housing for the motor;
- a handle and trigger for operating the motor;
- a swirl valve configured to impart swirling motion in the pressurized paint;
- a turret assembly having a reversible spray tip receiving the pressurized paint; and
- a swirl chamber adapter removably coupled to the turret assembly and positioned between the swirl valve and at least a portion of the turret assembly.

2. The apparatus of claim 1, wherein the swirl chamber adapter comprises external threads for removably receiving the turret assembly.

3. The apparatus of claim 2, wherein the spray gun further comprises a cylinder having external threads and containing the swirl valve.

4. The apparatus of claim 3, wherein the swirl chamber adapter further comprises internal threads configured to receive the external threads of the cylinder.

5. The apparatus of claim 1, wherein the swirl chamber adapter is at least partially positioned between an outlet of the swirl valve and an inlet of the turret assembly.

6. The apparatus of claim 5, wherein the swirl chamber adapter further comprises:
- a generally planar face opposing the outlet of the swirl valve; and
- a swirl chamber upstream of the turret assembly.

7. The apparatus of claim 6, wherein the swirl chamber adapter further comprises a centrally located bore in fluid communication with the swirl valve and extending from the generally planar face to an outlet of the swirl chamber adapter to deliver the paint from the gun to the turret assembly.

8. The apparatus of claim 6, wherein the swirl chamber adapter further comprises an external flange spaced apart from the generally planar face by a predetermined distance.

9. The apparatus of claim 8, wherein the predetermined distance is selected to provide a predetermined axial preload on the swirl valve.

10. The apparatus of claim 1 wherein the swirl chamber adapter further comprises an external gripping surface.

11. The apparatus of claim 10 wherein the external gripping surface is in the form of at least one of:
- a hexagonal periphery
- a spline surface;
- a pair of parallel wrench flats; and
- a knurled hand ring.

12. The apparatus of claim 1, and further comprising:
- a connection mechanism configured to threadably receive the paint cup.

13. The apparatus of claim 12, wherein the connection mechanism is retained at least partially within the housing.

14. The apparatus of claim 12, wherein the connection mechanism is formed on the housing.

15. A hand-held paint spray cup gun apparatus comprising:
- a removable paint cup;
- an airless paint pump assembly configured to receive paint from the paint cup;
- a motor configured to drive the pump assembly to pressurize the paint;
- a swirl valve configured to impart swirling motion in the pressurized paint;
- a turret assembly having a reversible spray tip receiving the pressurized paint; and
- a swirl chamber adapter positioned at an inlet of the turret assembly, the swirl chamber adapter having an opening that receives the swirl valve therein.

16. The apparatus of claim 15, wherein the swirl chamber adapter is at least partially positioned between the swirl valve and a portion of the turret assembly.

17. The apparatus of claim 15, wherein the swirl chamber adapter further comprises:
- a generally planar face opposing an outlet of the swirl valve; and
- a swirl chamber upstream of the turret assembly.

18. The apparatus of claim 15, wherein the swirl chamber adapter is removably coupled to the turret assembly.

19. The apparatus of claim 15, wherein the airless paint pump assembly comprises a reciprocating piston.

20. The apparatus of claim 15, wherein the motor is positioned within a housing, the housing supporting a handle and trigger for operating the motor.

* * * * *